United States Patent [19]

Ozeki

[11] Patent Number: 4,660,620

[45] Date of Patent: Apr. 28, 1987

[54] ARRANGEMENT FOR CONTROLLING AN INJECTION PROCESS OF A DIE CASTING MACHINE

[75] Inventor: Mamoru Ozeki, Zama, Japan

[73] Assignee: Toshiba Kikai Kabushiki Kaisha, Tokyo, Japan

[21] Appl. No.: 763,769

[22] Filed: Aug. 8, 1985

Related U.S. Application Data

[63] Continuation of Ser. No. 507,034, Jun. 23, 1983, abandoned.

[30] Foreign Application Priority Data

Jun. 25, 1982 [JP] Japan ..... 57-108343

[51] Int. Cl.[4] ..... B22D 17/32

[52] U.S. Cl. ..... 164/457; 164/113; 164/155; 164/312; 164/315

[58] Field of Search ..... 164/4.1, 113, 119, 120, 164/150, 154, 155, 312, 313, 314, 315, 457

[56] References Cited

U.S. PATENT DOCUMENTS

| | | | |
|---|---|---|---|
| 3,964,537 | 6/1976 | Koch et al. | 164/315 |
| 4,066,189 | 1/1978 | Toyoaki et al. | 164/155 |
| 4,252,176 | 2/1981 | Page | 164/312 |

*Primary Examiner*—Nicholas P. Godici

*Assistant Examiner*—Richard K. Seidel

*Attorney, Agent, or Firm*—Cushman, Darby & Cushman

[57] ABSTRACT

An arrangement for controlling an injection process for a die casting machine comprising an injection cylinder connecting to a plunger tip, a hydraulic circuit arrangement which supplies pressurized hydraulic oil to the cylinder at a plurality of rates of flow, and a control unit applying to the hydraulic circuit arrangement a plurality of signals when the plunger tip comes to a plurality of positions so as to change the middle speed of the plunger tip during one injection process, the hydraulic circuit arrangement providing with a plurality of combinations among a valve of the type of a pilot operated check valve which mounts a flow rate setting unit with a mechanical stopper and two position directional valve operated by the signals, and a method for operating the die casting machine comprising the steps of pouring melted metal into the injection cylinder, moving the plunger tip at a low speed to a position at which the level of the melted metal in the cylinder reches up to a portion near an entrance to a cavity formed by the dies, then further moving the plunger tip at a middle speed, and moving the plunger tip at a high speed faster than the middle speed so as to mold the melted metal into whole of the cavity.

9 Claims, 8 Drawing Figures

26
23
20
21
18
19
10
24
22
16
12
26
23
LOW SPEED 21
24
26
MIDDLE SPEED
23
22

21
24
26
20
22
HIGH SPEED
23

12
10
24
16
14

ARRANGEMENT FOR CONTROLLING AN INJECTION PROCESS OF A DIE CASTING MACHINE

This is a continuation, of application Ser. No. 507,034, filed June 23, 1983, which was abandoned upon the filing hereof.

BACKGROUND OF THE INVENTION

The present invention relates in general to die casting machines. More specifically, the present invention provides an apparatus and a method for controlling the speed of a plunger slideably mounted inside of a sleeve provided as part of the machine, thereby controlling the flow rate and pressure of melted metal being charged into a casting cavity by the plunger.

In general, the flow rate and pressure of melted metal being charged into the cavity of a die casting machine influence the quality of molded articles formed therein. A conventional injection process is essentially a two step process. In the first step, the plunger is controlled so as to move forward at a first (low) speed thereby preventing melted metal from being rough in the sleeve as the plunger moves, after the metal is poured in the sleeve.

At the second (last) step, the plunger is controlled so as to move forward at a second (high) speed for molding the melted metal into the cavity formed by male and female dies at a high rate of flow.

Referring to FIGS. 1(A), (B) and (C) there is illustrated the injection process mentioned above. Numeral 10 designates a hydraulic cylinder for carrying out the injection process. A piston 12 moves within cylinder 10 with a plunger 14 rigidly connected to the piston. A plunger tip 16 is mounted inside of a sleeve 18 into which a melted metal 22, such as, for example, melted aluminum is poured through an opening 19 before the plunger tip is moved to force the melted metal into the molding cavity (to the left as shown in FIG. 1(A)). Melted metal 22 is charged through a gate 24 into a cavity 21 formed by dies 20 and 23. A vent 26 provides an escape for air in cavity 21 as metal fills the cavity.

FIG. 1(A) shows the state of the die casting machine just after pouring melted metal 22 into sleeve 18. Plunger tip 16 is beginning to move at a low speed for carrying out the first step of the molding process.

When plunger tip 16 moves, passing through opening 19, to a position at which sleeve 18 is filled with melted metal 22 and the level of metal reaches up to gate 24 as shown in FIG. 1(B), the plunger tip is controlled to increase its speed to a high speed. Melted metal in the sleeve is molded into cavity 21 with a high rate of flow as shown in FIG. 1(C).

Since melted metal 22 becomes solidified in a very short time after it enters into cavity 21, it is necessary for the melted metal to be molded into cavity 21 with a considerably high rate near gate 24. At such a high rate of metal flow, air in cavity 21 cannot completely escape through vent 26, and melted metal 22 is charged into cavity 21 from a portion of gate 24 as a jet. This results in pin holes being formed in articles molded in cavity 21. These pin holes are formed by remaining air or a blow hole is formed by involving the air therein.

SUMMARY OF THE INVENTION

The present invention provides an arrangement for overcoming the above-mentioned problems associated with known casting machines and preventing the formation of pin holes and blow holes in a molded article.

The present invention also provides a hydraulic circuit arrangement for carrying out a casting process at lower cost than is possible with known machines.

To accomplish these improved results, the present invention provides a novel controlling method for an injection process and an apparatus for carrying out the new method. The method according to the present invention includes the steps of: pouring melted metal in a sleeve through an opening; moving a plunger tip at a low speed to a position at which the level of melted metal in the sleeve reaches up to a gate portion; then further moving the plunger tip at one or a plurality of middle speed values in order to permit air in the cavity to escape from it; and molding the melted metal into the cavity while the plunger moves at a high speed, thereby producing articles not having pin holes or a blow hole.

In essence, the present invention provides an injection molding machine, comprising: a sleeve for receiving melted metal poured through an opening therein, a pair of dies forming a cavity in which an article is to be molded from the melted metal, the dies having an air vent through which air remaining in the cavity can escape as melted metal is charged into the cavity during an injection process, a gate through which melted metal standing in the sleeve flows into the cavity, a plunger tip slidably mounted inside the sleeve, the plunger tip being securely connected to a piston rod of a hydraulic cylinder, a hydraulic circuit arrangement for supplying pressurized hydraulic oil from a pressurized hydraulic source to the cylinder, and a control unit for producing a signal applied to the hydraulic arrangement when the plunger tip reaches a position at which the moving speed of the plunger tip is to be changed during one injection process, the control unit including: means for detecting a position of the plunger tip; position setting means for setting a plurality of positions at which speeds of plunger tip are changed; and signal producing means for producing a plurality of signals, each signal being applied to the hydraulic circuit arrangement when the plunger tip reaches a corresponding set position during one injection process so as to change the speed of the plunger tip.

The present invention also provides a control unit for use with an injection molding machine, comprising: a sleeve into which melted metal is poured through an opening, a pair of dies forming a cavity in which an article is molded, the dies having an air vent through which the oil remaining in the cavity escapes as the melted metal is charged into the cavity during the injection process, a gate through which the melted metal standing in the sleeve flows into the cavity, a plunger tip slidably mounted inside of the sleeve, the plunger tip being securely connected to a piston rod of a hydraulic cylinder, a hydraulic circuit arrangement which supplies pressurized hydraulic oil from a pressurized hydraulic source to the cylinder and a control unit for producing a signal applied to the hydraulic arrangement when the plunger tip reaches a position at which moving speed of the plunger tip is changed during one injection process. The control unit includes an arrangement for detecting a position of the plunger tip, a position setting arrangement for setting a plurality of positions at which speeds the plunger tip is changed, and a signal producing arrangement for producing a plurality of signals, each signal being applied to the hydraulic circuit arrangement when the plunger tip reaches the set positions during one injection process so as to change the speed of the plunger tip.

In addition to these apparatus, the invention also provides a method for operating an injection molding machine including a sleeve into which melted metal is poured through an opening, a pair of dies forming a cavity in which an article is molded, the dies having an air vent through which air remaining in the cavity escapes as the melted metal is charged into the cavity during the injection process, a gate through which melted metal standing in the sleeve flows into the cavity, a plunger tip slidably mounted inside of the sleeve, the plunger tip being securely connected to a piston rod of a hydraulic cylinder, a hydraulic circuit arrangement which supplies pressurized hydraulic oil from a pressurized hydraulic source to the cylinder and a control unit for producing a signal applied to the hydraulic arrangement when the plunger tip reaches a position at which moving speed of said plunger tip is changed during one injection process, the method comprising the steps of:

pouring the melted metal in the sleeve through the opening;

moving the plunger tip at a first speed to a position at which the level of melted metal standing in the sleeve reaches up to a portion near said gate, then further moving the plunger tip at a second speed, and moving the plunger tip at a third speed faster than said second speed so as to mold the melted metal into the whole of said cavity.

BRIEF DESCRIPTION OF THE DRAWINGS

The presently preferred embodiment of the present invention will be described with reference to the drawings forming a part of this patent, wherein.

DETAILED DESCRIPTION OF THE PREFERRED EMBODIMENT

Figures 2, 2C:
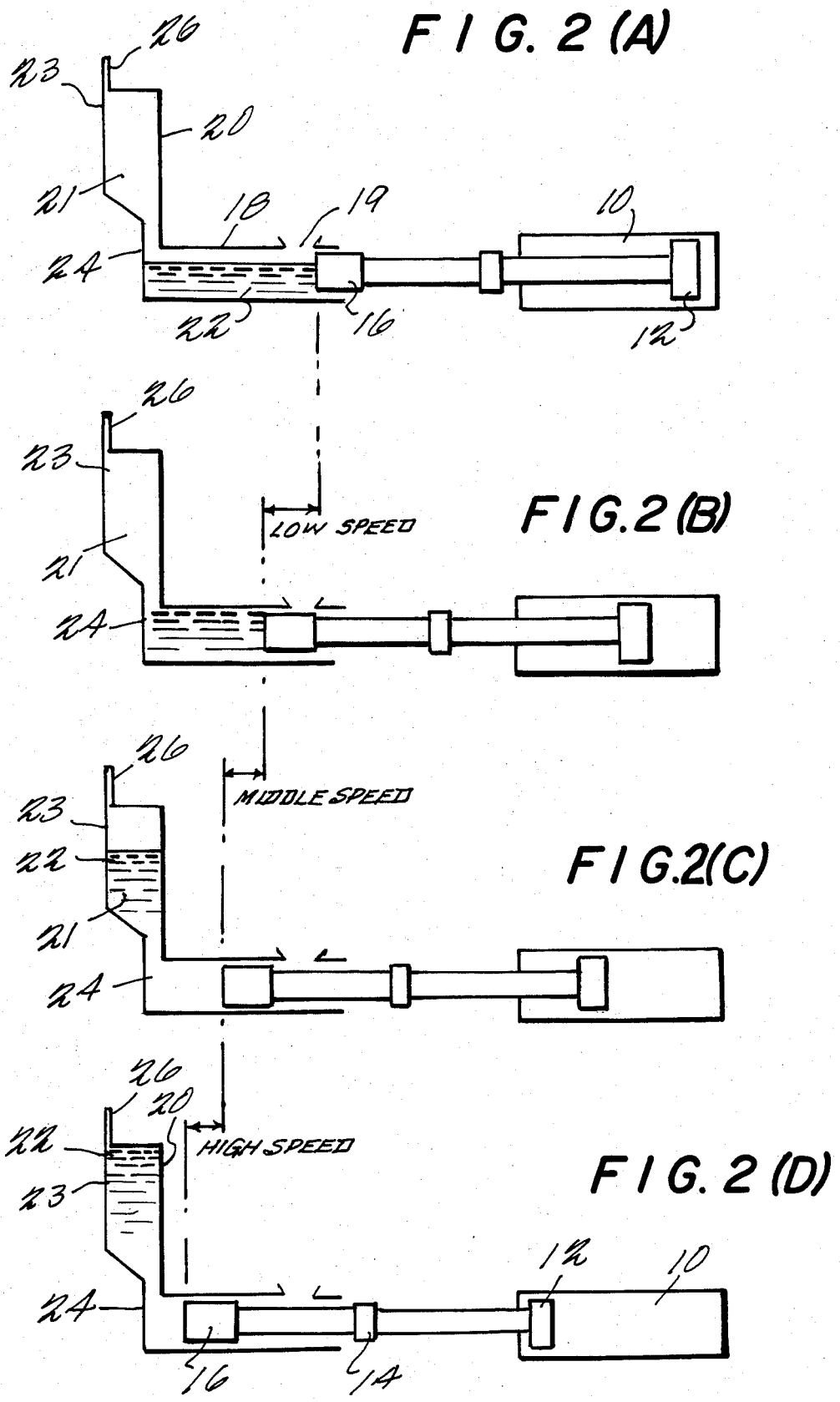
FIGS. 2(A), (B), (C) and (D) are sectional views of the injection apparatus in progressive states of operation showing the method of the present invention.
Figure 3:
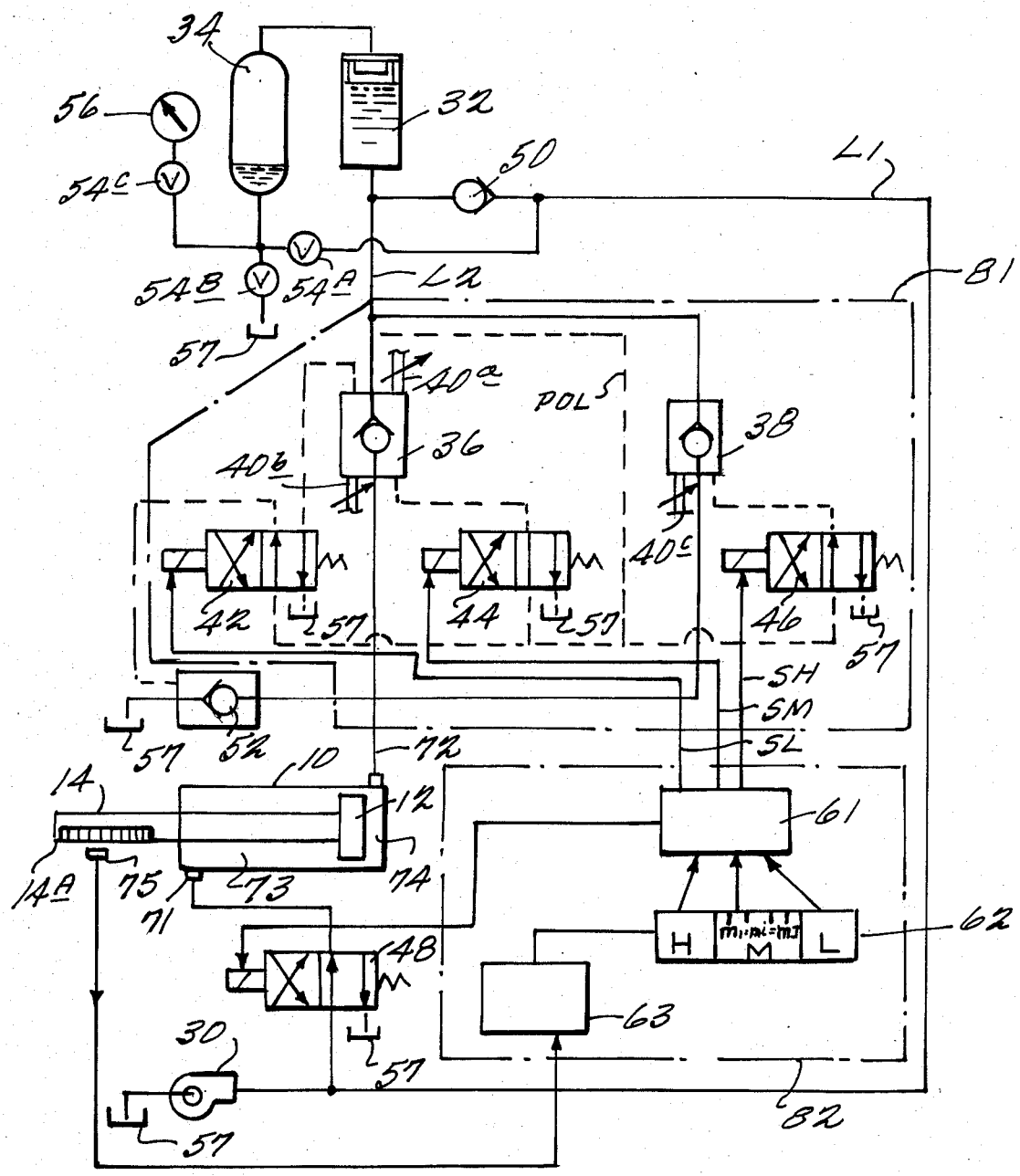
FIG. 3 is a schematic diagram of a hydraulic circuit arrangement of the present invention.

Reference will now be made to FIGS. 2 and 3 wherein the presently preferred embodiments of the present invention including control method and apparatus are illustrated.

Figure 1:
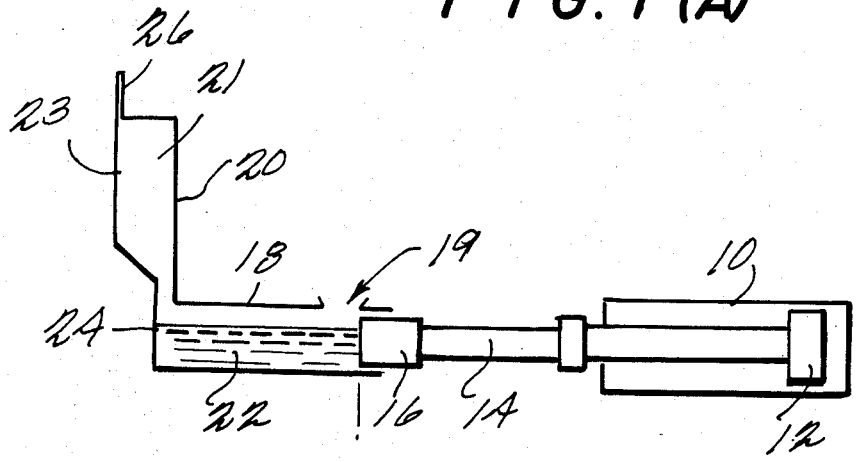
FIGS. 1(A), (B) and (C) are sectional views of a conventional injection apparatus in progressive states of operation.
Figure 1:
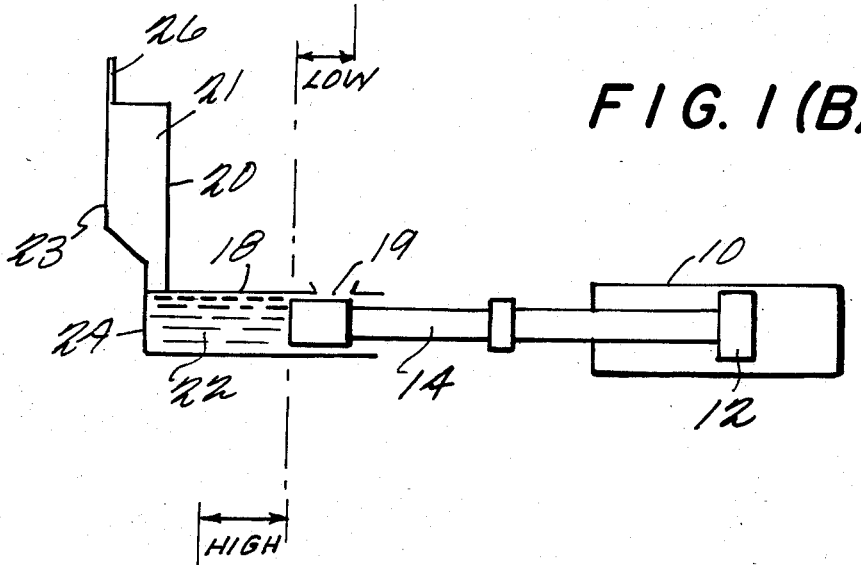
Figure 1:
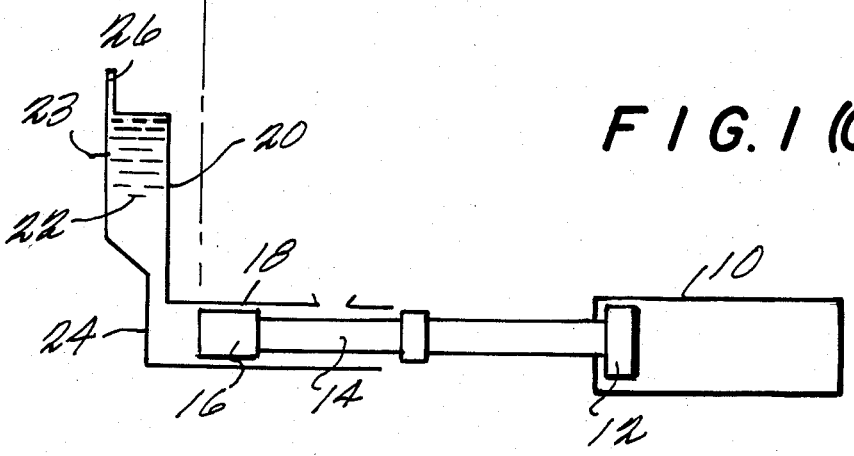

FIGS. 2(A), 2(B) and 2(D) are substantially identical to FIGS. 1(A), 1(B) and 1(C), respectively. Corresponding reference numerals refer to corresponding elements. However, FIG. 2(C) illustrates the additional step of operating at a middle speed for a portion of the injection molding process.

FIG. 2(A) illustrates a state showing sleeve 18 wherein melted metal 22 is poured through opening 19. Plunger tip 16 is moving at a first low speed. As shown in FIG. 2(B), plunger tip 16 is moving at a first low speed to a position at which sleeve 18 is filled with melted metal 22 up to a portion near gate 24. Then, the speed of plunger tip 16 begins to change from the first low speed to a second middle speed faster than the first low speed under the state shown in FIG. 2(B). The range of the middle speed is controlled so as to effectively allow the air in cavity 21 to escape.

As shown in FIG. 2(C), when melted metal 22 is charged in cavity 21 up to about one half of the cavity's volume, the speed of plunger 14 begins to change from the middle speed to a third high speed.

While plunger 14 moves at the high speed, melted metal 22 in sleeve 18 is charged at a very high rate of flow through gate 24 and molded into the whole volume of cavity 21 as shown in FIG. 2(D).

Referring now to FIG. 3 there is shown a schematic diagram of a hydraulic circuit arrangement for controlling cylinder 10 which provides with piston 12 securely connected to plunger tip 16 control of the speed of plunger tip 16.

A hydraulic pump 30 supplies pressurized hydraulic oil to a gaseous accumulator 34 and a piston accumulator 32 driven by gaseous accumulator 34 through line L1, a stop valve 54A and a check valve 50. Stop valves 54B and 54C are used for discharging the hydraulic oil to an oil reservoir tank 57 for maintenance of gaseous accumulator 34, and for watching an oil pressure gauge 56, respectively.

Stop valve 54A is closed after the pressurized hydraulic oil is supplied to gaseous accumulator 34 through it.

Hydraulic pump 30 also supplies the hydraulic oil via a two position directional valve 48 and an oil port 71 to a left side oil room 73, thereby permitting piston 12 and plunger 14 to be moved right away. Plunger 14 provides with a scale 14A facing to a sensor 75 on the machine, which produces pulses in accordance with movement of plunger 14.

A hydraulic circuit arrangement 81 supplies pressurized hydraulic oil flowing via a line L2 to a right side room 74 of cylinder 10, and the flow rates of the hydraulic oil supplied through a port 72 to cylinder 10 is capable of being changed by electric signals from a position setting unit 82.

Hydraulic circuit arrangement 81 comprises two flow control valves 36 and 38, each provided with a flow rate setting unit which is adjustable by an operator, and three directional values 42, 44 and 46 of two position type.

A pilot operating check valve 52 is connected to port 72 so as to return hydraulic oil standing in right side room 74 of cylinder 10 to tank 57 for moving plunger 14 back (right direction as shown in the figure).

Flow control valve 36, that is substantially a type of pilot operated check valve, in hydraulic circuit arrangement 81 provided with two flow setting units **40*a* and 40*b***.

Flow setting unit **40*a* operates to allow pressurized hydraulic oil on line L2 to pass through flow control valve 36 at a rate of flow set by the unit 40*a*, when a signal of low speed SL is applied from position setting unit 82 to two position directional valve 42 through which pressurized hydraulic oil on a line POL leads to flow control valve 36**.

Under the condition that signal SL is applied, flow setting unit **40*b* operates also to allow hydraulic oil on line L2 to pass through flow control valve 36 at a rate of flow set by the unit 40*b*, when a signal indicative of middle speed SM is applied from position setting unit 82 to two position directional valve 44 which blocks the pressurized hydraulic oil on the line POL to lead to flow control valve 36**.

Another flow control valve 38 in hydraulic circuit arrangement 81 provided with a flow setting unit **40*c* which operates to allow pressurized hydraulic oil on line L2 to pass through flow control valve 38 at a rate of flow set by flow setting unit 40***c* under the condition that signal SL is applied to valve 42 and signal SM is not applied to valve 44, when a signal SH is applied from position setting unit 82 to two position directional valve 46 which blocks the pressurized hydraulic oil on the line POL to lead to flow control valve 38.

Position setting unit 82 comprises a position register 63 which receives feed back pulses sent from sensor 75 and produces a reference position for comparing it with a plurality of positions being set in a position setter 62, and a signal producing unit 61. Position setter 62 in the present embodiment, has three positions with respect to moving of plunger 14. A first position L among them corresponds to the position from which plunger tip 16 begins to move forward at a low speed, as shown in FIG. 2(A).

A second position M corresponds to the position from which plunger tip 16 moves forward at the middle speed, as shown in FIG. 2(C).

A third position H corresponds to the position from which plunger tip 16 moves still forward at a high speed, as shown in FIG. 2(D).

Signal producing unit 61 produces abovementioned signals necessary for energizing or deenergizing operation of each two position directional valve 42, 44, 46 or 48 when the value of position register 63 coincides with each valve set by position setter 62. Two position directional valves 42, 44 and 46 are de-energized, and at the same time the valve 48 is de-energized after for a while since plunger reaches to a position corresponding to completion of molding process.

Each flow setting unit 40*a*, 40*b* or 40*c* is provided with a mechanical stopper which position is adjusted by the operator so as to precisely set a desirable rate of flow. In the present embodiment shown in FIG. 3, only one middle speed of plunger tip 16 is capable of being set. However, the present invention is not limited to providing only one middle speed.

In order to provide a hydraulic circuit arrangement which allows plunger tip 16 to move with a plurality of middle speeds (a fashion of multi stage) during one injection process, it is necessary that a type of combination such as flow control valve 36 and flow setting units 40*a* and 40*b* or flow control valve 38 and flow setting unit 40*c* should be located on, in association with corresponding two position directional valve such as valves 42, 44 and 46, which operation is controlled by a position setting unit having multi stage setting positions for various middle speeds.

In case of adopting the multi stage fashion, it is preferable that middle speeds of the first stage and the last stage are nearly equal to the low speed and the high speed, respectively.

Other embodiments of hydraulic circuit arrangement 81 may be constituted by using an electromagnetic proportional valve such as a servo valve (though at present this alternative is too expensive to be practical) which is controlled by valves of current applied to it. In the case, signal producing unit 61 should be modified so as to produce electric current proportional to each middle speed among the multi stages.

According to the present invention, it is an advantage that air remaining in the cavity is capable of smoothly escaping by adding one or a plurality of middle speeds of the plunger tip in one injection process, thereby producing articles without pin holes or blow holes.

In other words, this invention provides not only an apparatus, but also a method for operating a conventional injection molding machine. This method applies to operating an injection molding machine including a sleeve into which melted metal is poured through an opening, a pair of dies forming a cavity in which an article is molded, said dies having an air vent through which the air remaining in said cavity escapes as the melted metal is charged into said cavity during the injection process, a gate through which said melted metal standing in said sleeve flows into said cavity, a plunger tip slidably mounted inside of said sleeve, the plunger tip being securely connected to a piston rod of a hydraulic cylinder, a hydraulic circuit arrangement which supplies pressurized hydraulic oil from a pressurized hydraulic source to said cylinder and a control unit for producing a signal applied said hydraulic arrangement when said plunger tip reaches a position at which moving speed of said plunger tip is changed during one injection process, the method comprising the steps of:

pouring the melted metal in the sleeve through the opening;

moving the plunger tip at a first speed to a position at which the level of melted metal standing in the sleeve reaches up to a portion near the gate, then further moving the plunger tip at a second speed, and moving the plunger tip at a third speed faster than the second speed so as to mold melted metal into the whole of the cavity.

While the invention has been described in connection with what is presently considered to be the most practical and preferred embodiments, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

I claim:

1. An injection molding machine comprising:

sleeve means for receiving melted metal poured through an opening therein, a pair of dies forming a cavity in which an article is to be molded from said melted metal, said dies having an air vent through which air remaining in said cavity can escape as melted metal is charged into said cavity during an injection process, a gate through which melted metal standing in said sleeve means flows into said cavity, a plunger tip slidably mounted-inside said sleeve, said plunger tip being securely connected to a piston rod of a hydraulic cylinder, a hydraulic circuit arrangement for supplying pressurized hydraulic oil from a pressurized hydraulic source to said cylinder for controlling the speed of said plunger tip, and a control unit for producing a signal applied to said hydraulic arrangement when said plunger tip reaches a position at which the moving speed of said plunger tip is to be changed during one injection process, said control unit including:

means for detecting a position of said plunger tip;

position setting means for setting a plurality of positions at which speed of said plunger tip are changed, said speeds consisting of a slowest speed, a middle speed, and a fastest speed, said plurality of positions including a position at which said plunger tip is to be moved at said middle speed that is greater than the slowest speed and less than the fastest speed of said plunger tip, said middle speed being operable up to a point where melted metal has transited said gate into said cavity but before said cavity is filled with melted metal; and signal producing means for producing a plurality of signals, each signal being applied to said hydraulic circuit arrangement when said plunger tip reaches a corresponding set position during one injection process so as to control the speed of said plunger tip from the point at which it reaches the corresponding position.

2. An injection molding machine according to claim 1, wherein said hydraulic circuit arrangement comprises valve means for allowing said pressurized hydraulic oil to flow therethrough in response to said signals provided by said control unit.

3. An injection molding machine according to claim 2, wherein said valve means comprises a plurality of combinations of two position directional valve and a flow control valve of the type of a check valve, said flow control valve mounting a flow rate setting unit with a mechanical stopper.

4. A metal casting control unit for use with an injection molding machine, said injection molding machine including: a sleeve to which melted metal is poured through an opening, a pair of dies forming a cavity in which an article is molded, said dies having an air vent through which air remaining in said cavity escapes as the melted metal is charged into said cavity during the injection process, a gate through which said melted metal standing in said sleeve flows into said cavity, a plunger tip slidably mounted inside of said sleeve, the plunger tip being securely connected to a piston rod of a hydraulic cylinder, a hydraulic circuit arrangement which supplies pressurized hydraulic oil from a pressurized hydraulic source to said cylinder and a control unit for producing a signal applied to said hydraulic arrangement when said plunger tip is charged during one injection process, said control unit comprising:

means for detecting a position of said plunger tip, position setting means for setting a plurality of positions at which speeds of said plunger tip are changed, said speeds consisting of a slowest speed, a middle speed, and a fastest speed, said plurality of positions including a position at which said plunger tip is to be operated at said middle speed greater than the slowest plunger tip speed and slower than the fastest plunger tip speed, said middle speed being operable up to a point where melted metal has transited said gate into said cavity but before said cavity is filled with said melted metal, and signal producing means for producing a plurality of signals, each signal being applied to said hydraulic circuit arrangement when said plunger tip reaches a corresponding set position during one injection process at so as to control the speed of said plunger tip from the point at which it reaches the corresponding position.

5. A control unit for use with an injection molding machine according to claim 4, wherein said hydraulic circuit arrangement comprises: valve means for allowing said pressurized hydraulic oil to flow therethrough in response to said signals provided by said control unit.

6. A control unit for use with an injection molding machine according to claim 5, wherein said valve means comprises: a plurality of combinations of two position directional valve and a flow control valve of the type of a check valve, said flow control valve mounting a flow rate setting unit with a mechanical stopper.

7. A control unit for use with an injection molding machine according to claim 4, wherein said hydraulic circuit arrangement comprises valve means for allowing said pressurized hydraulic oil to flow therethrough in response to said signals provided by said position setting means.

8. A control unit for use with an injection molding machine according to claim 7, wherein said valve means comprises: a plurality of combinations of two position directional valve and a flow control valve of the type of a check valve, said flow control valve mounting a flow rate setting unit with a mechanical stopper.

9. A method for operating an injection molding machine including a sleeve into which melted metal is poured through an opening, a pair of dies forming a cavity in which an article is molded, said dies having an air vent through which the air remaining in said cavity escapes as the melted metal is charged into said cavity during the injection process, a gate through which said melted metal standing in said sleeve flows into said cavity, a plunger tip slidably mounted inside of said sleeve, the plunger tip being securely connected to a piston rod of a hydraulic cylinder, a hydraulic circuit arrangement which supplies pressurized hydraulic oil from a pressurized hydraulic source to said cylinder and a control unit for producing a signal applied said hydraulic arrangement when said plunger tip reaches a position at which moving speed of said plunger tip is changed during one injection process, said method comprising the steps of:

pouring the melted metal in the sleeve through the opening;

moving the plunger tip at a plurality of speeds consisting of a first speed, a second speed, and a third speed, said moving step including the steps of (a) moving the plunger tip at said first speed to a position at which the level of said melted standing in said sleeve reaches up to a portion near said gate, (b) then further moving said plunger tip at said second speed so as to mold said melted metal into said cavity, said plunger moving at said second speed until melted metal has transited said gate into said cavity but before said melted metal fills said cavity, and (c) moving said plunger tip at said third speed faster than said second speed so as to mold said melted metal into the whole of said cavity.

* * * * *